US010641568B2

(12) United States Patent
Zinsner et al.

(10) Patent No.: US 10,641,568 B2
(45) **Date of Patent: *May 5, 2020**

(54) FREE-FLOATING RIFLE RAIL AND BARREL LOCKING SYSTEM(S)/ASSEMBLIES

(71) Applicant: Brendon Zinsner, Sarasota, FL (US)

(72) Inventors: Brendon Zinsner, Sarasota, FL (US); Lisa Fitzgerald, Leesburg, FL (US)

(73) Assignee: Brendon Zinsner, Sarasota, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/456,284

(22) Filed: Jun. 28, 2019

(65) Prior Publication Data

US 2020/0025484 A1 Jan. 23, 2020

Related U.S. Application Data

(63) Continuation of application No. 16/179,226, filed on Nov. 2, 2018, now Pat. No. 10,359,248.

(60) Provisional application No. 62/581,098, filed on Nov. 3, 2017.

(51) Int. Cl.

| | |
|---|---|
| ***F41A 11/04*** | (2006.01) |
| ***F41A 21/48*** | (2006.01) |
| ***F41C 7/11*** | (2006.01) |
| ***F41C 23/16*** | (2006.01) |
| ***F41G 11/00*** | (2006.01) |
| ***F41A 11/02*** | (2006.01) |

(52) U.S. Cl.

CPC ..... *F41A 11/04* (2013.01); *F41A 11/02* (2013.01); *F41A 21/48* (2013.01); *F41A 21/482* (2013.01); *F41C 7/11* (2013.01); *F41C 23/16* (2013.01); *F41G 11/003* (2013.01)

(58) Field of Classification Search

CPC ..... F41A 11/04; F41A 21/48; F41C 7/11
USPC ..... 42/71.01, 75.01–75.03
See application file for complete search history.

(56) References Cited

U.S. PATENT DOCUMENTS 4,115,943 A * 9/1978 Musgrave ..... F41A 9/63 42/71.01
8,607,490 B1 * 12/2013 Zinsner ..... F41C 23/16 42/71.01
8,931,196 B1 * 1/2015 Larue ..... F41A 11/04 42/71.01

(Continued)

OTHER PUBLICATIONS http://www.defensereview.com—"Customized Multi-Caliber Combat/Tactical AR-15 Short Barreled Rifle (SBR) with Badass Quick-Change Barrel System, Folding Stock, Ultra-Light Tactical Handguards, and Super-Fast Binary Firing System Trigger Pack!" by David Crane, pub. Oct. 25, 2018 [all pages] (Year: 2018).

*Primary Examiner* — Samir Abdosh
(74) *Attorney, Agent, or Firm* — Shumaker, Loop & Kendrick, LLP

(57) ABSTRACT

A free-floating rifle rail and barrel locking system that provides a barrel assembly and rail assembly, which is detachable from the main body of a rifle without tools. This is advantageous for quick field breakdown and/or rifle modification. The user has the option to disassemble the rifle for easy transport, to change barrel length, to change barrel caliber or change rail configurations. The rails are free-floating, meaning the rails do not come in contact with the barrel and thus do not impact the precision of the rifle.

14 Claims, 13 Drawing Sheets

(56) References Cited

U.S. PATENT DOCUMENTS

| | | | | |
|---|---|---|---|---|
| 2007/0169393 | A1* | 7/2007 | Frost | F41G 11/003 42/124 |
| 2008/0295818 | A1* | 12/2008 | Styles | F41A 21/48 124/83 |
| 2010/0300277 | A1* | 12/2010 | Hochstrate | F41A 3/66 89/179 |
| 2015/0198403 | A1* | 7/2015 | Bentley | F41A 21/484 42/75.02 |
| 2015/0308779 | A1* | 10/2015 | McGinty | F41A 21/484 42/75.02 |
| 2019/0154396 | A1 | 5/2019 | Zinsner et al. | |

* cited by examiner

FREE-FLOATING RIFLE RAIL AND BARREL LOCKING SYSTEM(S)/ASSEMBLIES

TECHNICAL FIELD

The present invention relates generally to the field of rifles, and more particularly, to free-floating, quick release rifle rail and barrel locking systems/assemblies that are easily attached to and detached from the main body of a rifle (e.g., assault rifle main bodies) without tools.

BACKGROUND

Shooting enthusiasts have many commercially-available options to configure their AR-15 rifle(s), AR-10 rifle(s), and/or variants thereof for personal taste and/or shooting styles. These include, but are not limited to, optical scopes, laser sights, lights, tripods, barrel lengths and calibers. These options and accessories are available with standard attachment interfaces, including KeyMod and M-Lok. Commercially-available rail systems typically have one or both interfaces that are securely attached to the rifle but are not easily removed without specialized tools and expertise along with a lengthy time period for doing so. Although the shooting enthusiast may desire the quick and interchangeable use of one of more of the above mentioned accessories on their rifle, the shooting enthusiast may not have the time, tools, and/or expertise to accomplish this skilled task, which is often very problematic to the enthusiast lacking one or more of the above mentioned attributes.

BRIEF SUMMARY

Thus, a need exists to provide the shooting enthusiast with an alternative that overcomes the above mentioned problems. Thus, specifically disclosed is a free-floating, quick release rifle rail and barrel locking system(s) (also referred to as "quick release assembly" and/or "rail assembly" and/or "barrel assembly") that are detachable from the main body of a rifle (also referred to as "rifle assembly" or "assault rifle assembly") without tools. Attachment and detachment of these assemblies to the rifle main body are quite easy and can often be accomplished in less than, for example, 10 minutes, 5 minutes, or even less than two minutes in certain instances without any additional tools. The disclosed systems/assemblies use a hand-activated lever/latch system to easily remove both rail and barrel assemblies from the main body of a rifle. This eliminates the necessity for specialized tools and complex disassembly of the AR-15 rifle system, AR-10 rifle system, and/or variants thereof to change or add KeyMod/M-Lok accessories or complete rail systems. Thus, the disclosed systems/assemblies provide simplicity and allow the user to quickly change barrel(s) as desired.

In certain aspects, disclosed is a quick release assembly configured for attachment to an assault rifle assembly, the quick release assembly includes: (a) a rail assembly including (i) a sleeve configured to directly attach to the assault rifle assembly; (ii) an elongate rail mount having a first end and second end that are spaced apart from one another, wherein: the first end of the elongate rail mount securely receives the sleeve of the rail assembly therein, and the spaced apart second end of the elongate rail mount has flared cambered portions that are configured to securely mate within a rail of the rail assembly; and (iii) a rail having a first end and second end that are spaced apart from one another, wherein: the first end of the rail is configured to receive and securely mate with the flared cambered portions of the second end of the elongate rail mount to axially align the sleeve, elongate rail mount, and rail along the longitudinal axis of the rail assembly, the first end of the rail further includes a plurality of securing levers positioned externally thereon with a first securing lever configured to engage and disengage the elongate rail mount and a second securing lever configured to engage and disengage a barrel assembly to quickly release the rail and barrel assemblies from the assault rifle assembly, and the second end of the rail is configured to receive the barrel assembly therein; and (b) the barrel assembly including a barrel having a first end and a second end that are spaced apart from one another, wherein: a portion of the barrel assembly is configured to advance through the rail of the rail assembly and is securely received within the second end of the elongate rail mount such that the second securing lever of the rail assembly securely engages the barrel assembly such that the barrel assembly and rail assembly are axially aligned to form an internal channel in fluid communication with the assault rifle assembly such that a bullet may be fired there through and exit the second end of the barrel. In certain aspects, no additional tools are necessary to remove the rail assembly and/or barrel assembly from the assault rifle assembly (assault rifle main body).

In certain aspects, the barrel assembly further comprises a bushing configured for fastening around the first end of the barrel of the barrel assembly, the bushing having an opening that receives an arm of the second securing lever therein when the second securing lever is in an engaged position thereby securing the barrel assembly to the rail assembly.

In certain aspects, an inner diameter of the first end of the elongate rail mount securely engages the outer diameter of the sleeve of the rail assembly.

In certain aspects, the flared cambered portions of the elongate rail mount extend beyond an outer diameter of a main body of the elongate rail mount and are configured to align and securely mate within openings positioned on the rail.

In certain aspects, each of the plurality of securing levers is coplanar with an outer surface of the rail when in an engaged state.

In certain aspects, each of the plurality of securing levers is perpendicular relative to the longitudinal axis of the rail assembly when in a disengaged state.

In certain aspects, each assembly (e.g., the rail assembly or barrel assembly) of the quick release assembly may be separate (e.g., packaged, marketed, and/or sold separately) from one another. Thus, further disclosed is only the rail assembly for use in a quick release attachment to an assault rifle assembly, the rail assembly including (i) a sleeve configured to directly attach to the assault rifle assembly; (ii) an elongate rail mount having a first end and second end that are spaced apart from one another, wherein: the first end of the elongate rail mount securely receives the sleeve of the rail assembly therein, and the spaced apart second end of the elongate rail mount has flared cambered portions that are configured to securely mate within a rail of the rail assembly; and (iii) a rail having a first end and second end that are spaced apart from one another, wherein: the first end of the rail is configured to receive and securely mate with the flared cambered portions of the second end of the elongate rail mount to axially align the sleeve, elongate rail mount, and rail along the longitudinal axis of the rail assembly, the first end of the rail further includes a plurality of securing levers positioned externally thereon with a first securing lever configured to engage and disengage the elongate rail mount and a second securing lever configured to engage and disengage a barrel assembly to quickly release the rail and barrel assemblies from the assault rifle assembly, and the second end of the rail is configured to receive the barrel assembly therein. In certain aspects, no additional tools are necessary to remove the rail assembly from the assault rifle assembly (assault rifle main body).

In certain aspects, an inner diameter of the first end of the elongate rail mount securely engages the outer diameter of the sleeve of the rail assembly.

In certain aspects, the flared cambered portions of the elongate rail mount extends beyond an outer diameter of a main body of the elongate rail mount and are configured to align and securely mate within openings positioned within the rail.

In certain aspects, each of the plurality of securing levers is coplanar with an outer surface of the rail when in an engaged state.

In certain aspects, each of the plurality of securing levers is perpendicular relative to the longitudinal axis of the rail assembly when in a disengaged state.

As alluded to above, in certain aspects, each assembly (e.g., the rail assembly or barrel assembly) of the quick release assembly may be separate (e.g., packaged, marketed, and/or sold separately) from one another. Therefore, in certain aspects, also disclosed is only the barrel assembly for use in a quick release attachment to an assault rifle assembly, the barrel assembly comprising a barrel having a first end and a second end that are spaced apart from one another and a bushing fastened around the first end of the barrel of the barrel assembly, wherein the bushing has an opening that receives an arm of a securing lever of a rail assembly therein when the second securing lever is in an engaged position thereby securing the barrel assembly to the rail assembly such that the barrel and rail assemblies are axially aligned with one another and form an internal channel in fluid communication with an assault rifle assembly. In certain aspects, no additional tools are necessary to remove the barrel assembly from the assault rifle assembly (assault rifle main body).

In certain aspects and also further contemplated is a fully assembled rifle (e.g., AR-15, AR-10, or variants thereof) having the disclosed quick release assemblies attached thereon. In this aspect and as further shown and disclosed herein, is the quick release assembly attached to the rifle (also referred to as "assault rifle", "assault rifle assembly", AR-15, AR-10, or variants thereof), the quick release assembly includes: (a) a rail assembly including (i) a sleeve directly attached to the assault rifle assembly; (ii) an elongate rail mount having a first end and second end that are spaced apart from one another, wherein: the first end of the elongate rail mount securely receives the sleeve of the rail assembly therein, and the spaced apart second end of the elongate rail mount has flared cambered portions that are to securely mated within a rail of the rail assembly; and (iii) a rail having a first end and second end that are spaced apart from one another, wherein: the first end of the rail receives and is securely mated with the flared cambered portions of the second end of the elongate rail mount thereby axially aligning the sleeve, elongate rail mount, and rail along the longitudinal axis of the rail assembly, the first end of the rail further includes a plurality of securing levers positioned externally thereon with a first securing lever that engages and disengages the elongate rail mount and a second securing lever configured that engages and disengages a barrel assembly to quickly release the rail and barrel assemblies from the assault rifle assembly, and the second end of the rail receives the barrel assembly therein; and (b) the barrel assembly includes a barrel having a first end and a second end that are spaced apart from one another, wherein: a portion of the barrel assembly has been advanced through the rail of the rail assembly and is securely received within the second end of the elongate rail mount such that the second securing lever of the rail assembly securely engages the barrel assembly thereby axially aligning that the barrel assembly and rail assembly to form an internal channel in fluid communication with the assault rifle assembly such that a bullet may be fired there through and exit the second end of the barrel. In certain aspects, no additional tools are necessary to remove the rail assembly and/or barrel assembly from the assault rifle assembly (assault rifle main body).

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Referring to FIGS. 1, 13, 17, 18, 19, 20, and 21, the rail assembly 1 and barrel assembly 2 are an integral part of the AR-15 rifle assembly 3. The rail assembly 1 and barrel assembly 2 are detachable from the main AR-15 rifle assembly 3 by means of 3 attachment points as described herein.

Figure 13:
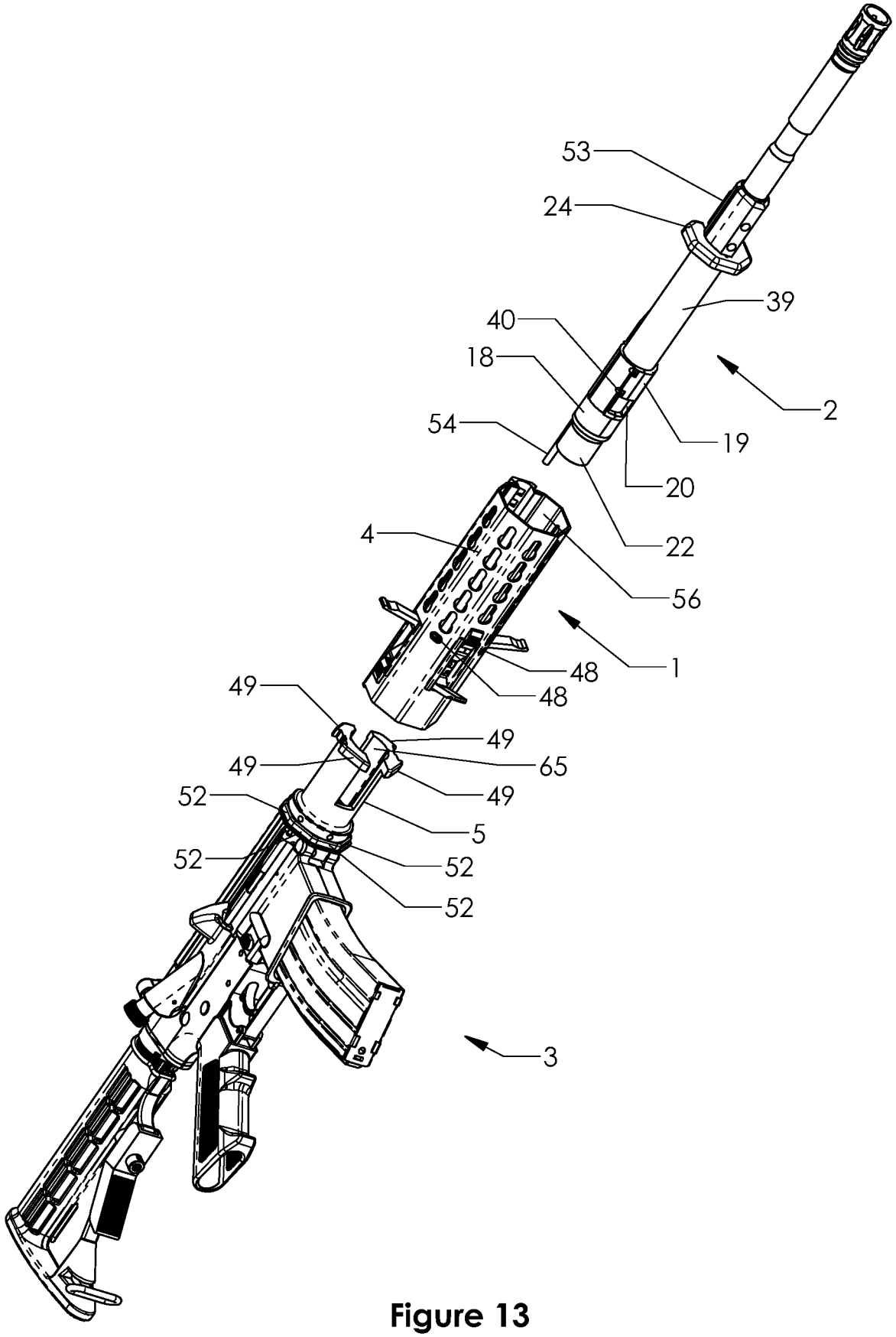
FIG. 13 is an Exploded isometric view of the rail and barrel assemblies.
Figure 14:
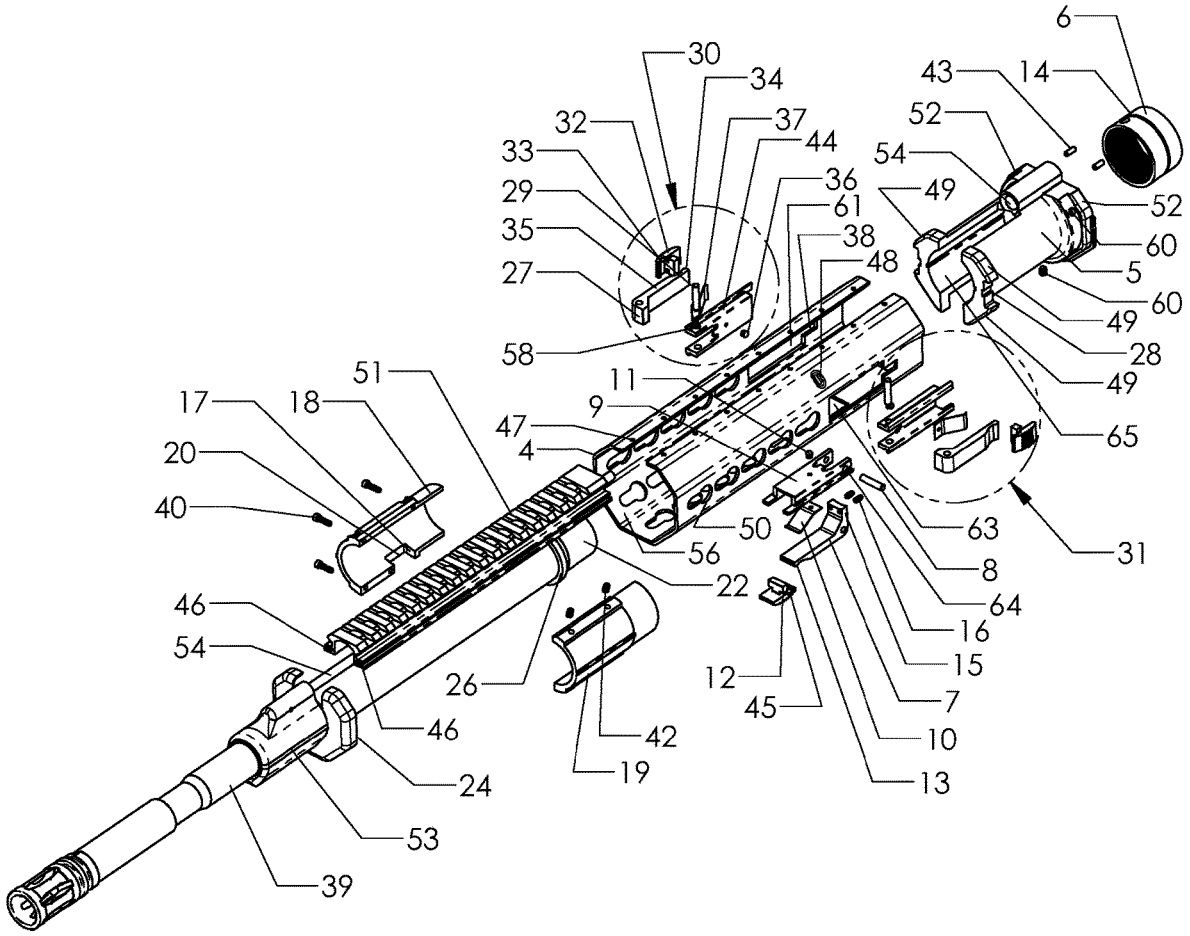
FIG. 14 is another Exploded isometric view of the rail and barrel assemblies.

Referring to FIGS. 13 and 14, the barrel assembly 2 includes the barrel 39, gas block 53, gas tube 54, rail front cover 24, and barrel extension 22, to provide a locking interface composed of the barrel bushing aperture 39 and barrel bushing aperture face 17. The barrel assembly 2 is fitted with barrel bushing left 18 and barrel bushing right 19 attached to barrel 39 by means of a plurality of barrel bushing screws 40. A plurality of set screws 42 are provided in the barrel bushing right 19 to allow for a tight fit regardless of manufacturing tolerance of barrel 39.

Referring to FIGS. 2, 3, 4, 5, 6, 7, 8, 9, 10, 11, 12, 13 and 14, the rail mount system 1 includes the rail 4, top rail mount 51, the assembly rail lever right 30 and the assembly rail lever left 31. The top rail mount 51 is designed to accept commercially available accessories for the AR-15 rifle. The top rail mount 51 is attached to the rail 4 by means a plurality of rail stud projections 47 nesting in a rail groove 46 on each side of the top rail mount 51. Rail 4 includes a plurality of keyhole slots 50. In this embodiment, slots are designed to accept KeyMod type commercially available accessories. In other embodiments the slot configuration can be changed to accept M-Lok or other types of commercially available accessories.

Assembly rail lever right 30 includes rail lever mount 44, rail lever pin 29, rail lock lever 35, rail lever retainer 32, rail lever spring 37 and rail lever spring rivet 36. Rail lock lever 35 is attached to rail lever mount 44 by means of rail lever pin 29 captured in pin aperture 58 in rail lever mount 44. Rail lever spring 37 is attached to rail lever mount 44 by means of rail lever spring rivet 36. The rail lever mount 44 then snap-fits into rail lever aperture 61 on rail 4 by means of tab lock 59. The parts and attachments of assembly rail lever left 31 are identical to assembly rail lever right 30 and is located on the opposite side of rail 4. This provides increased mechanical stability when the rail mount system 1 is attached to AR-15 rifle assembly 3.

Referring to FIGS. 2, 3, 4, 7 and 14, the rail mount assembly 1 also provides mounting of the barrel lock lever 7 to rail 4. Barrel lock 7 is attached to barrel lever mount 9 with pin 8 captured in barrel lever pin aperture 64. Barrel lever spring 10 is attached to barrel lever mount 9 by means of rivet 11. Barrel lever mount 9 then snap-fits into barrel lever aperture 63 on rail 4 by means of tab lock 59.

Figure 15:
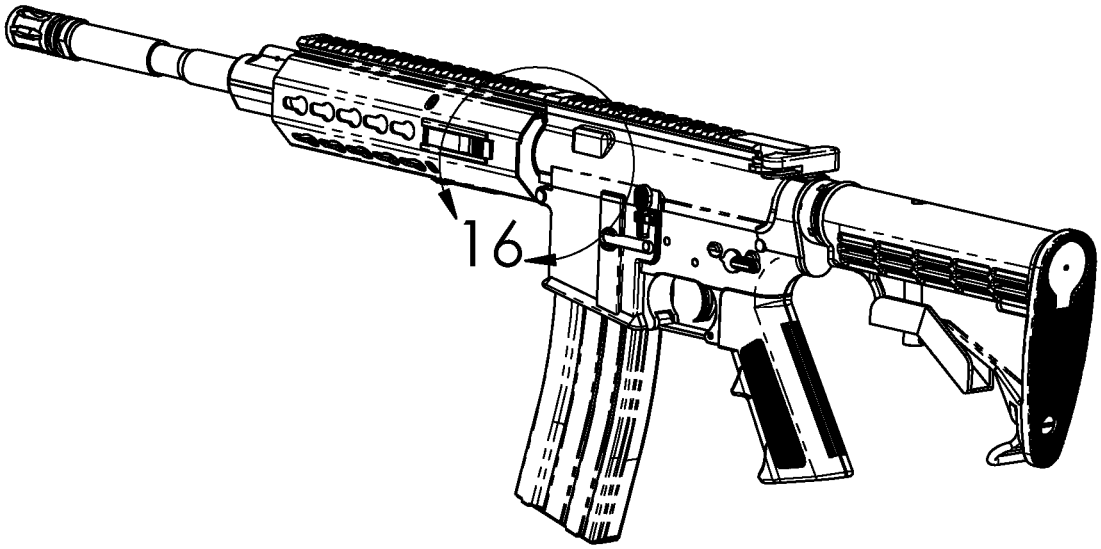
FIG. 15 is another Isometric view of the rail and barrel assemblies.
Figure 16:
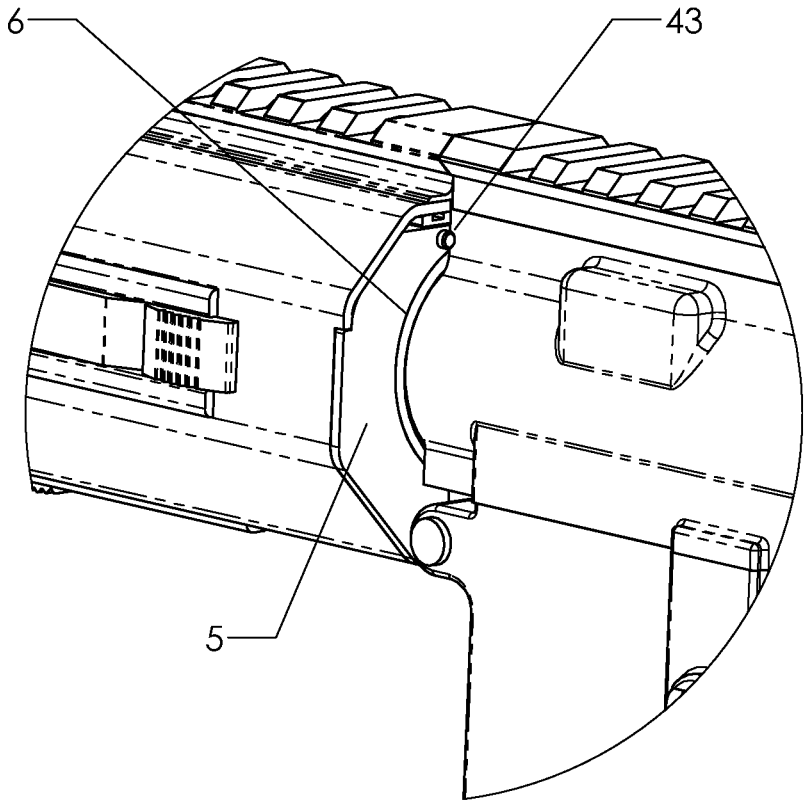
FIG. 16 is a magnified Detail view of FIG. 15.
Figure 17:
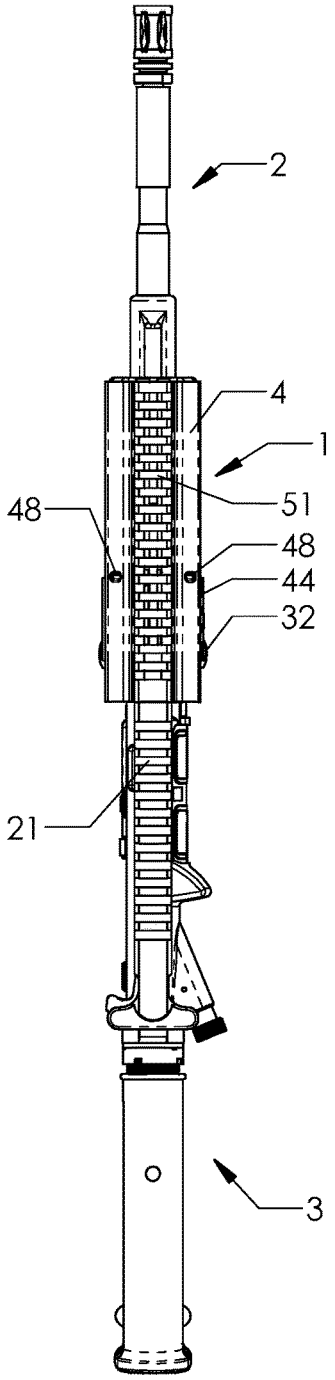
FIG. 17 is a Top view of the rail and barrel assemblies.
Figure 18:
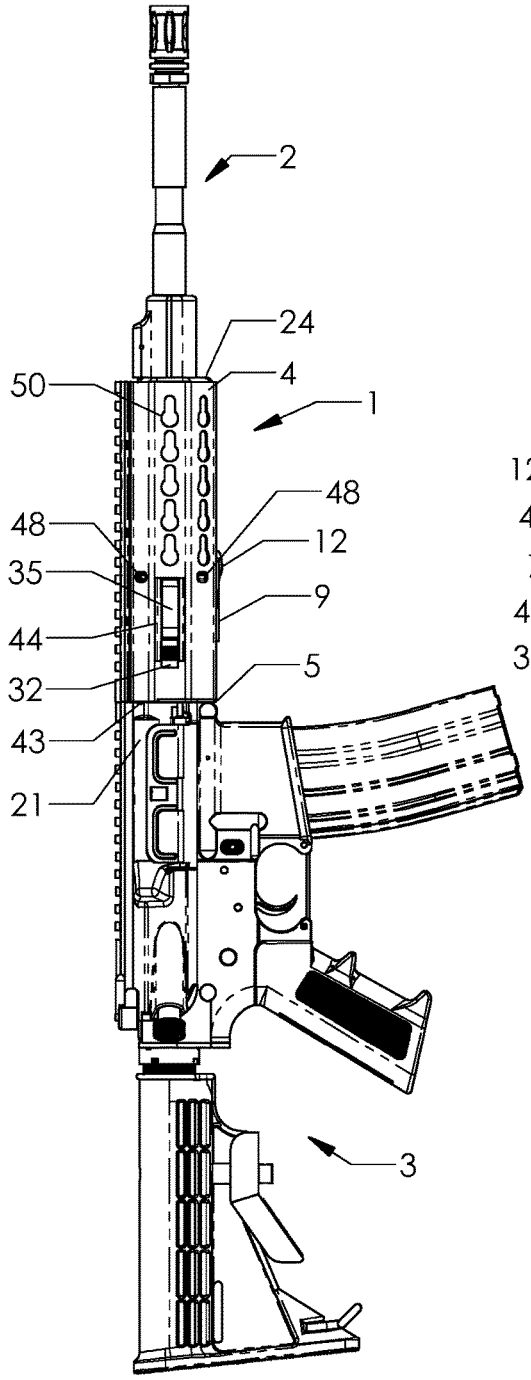
FIG. 18 is a Side view of the rail and barrel assemblies.
Figure 19:
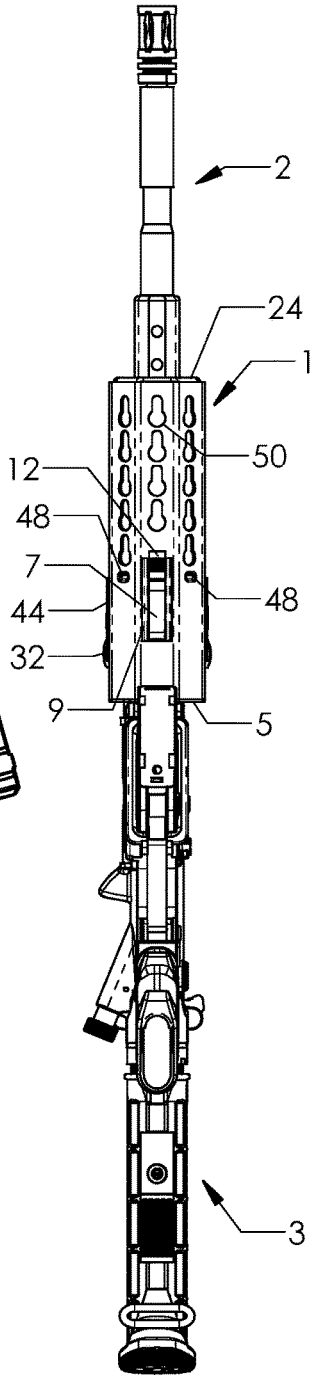
FIG. 19 is a Bottom view of the rail and barrel assemblies.
Figure 20:
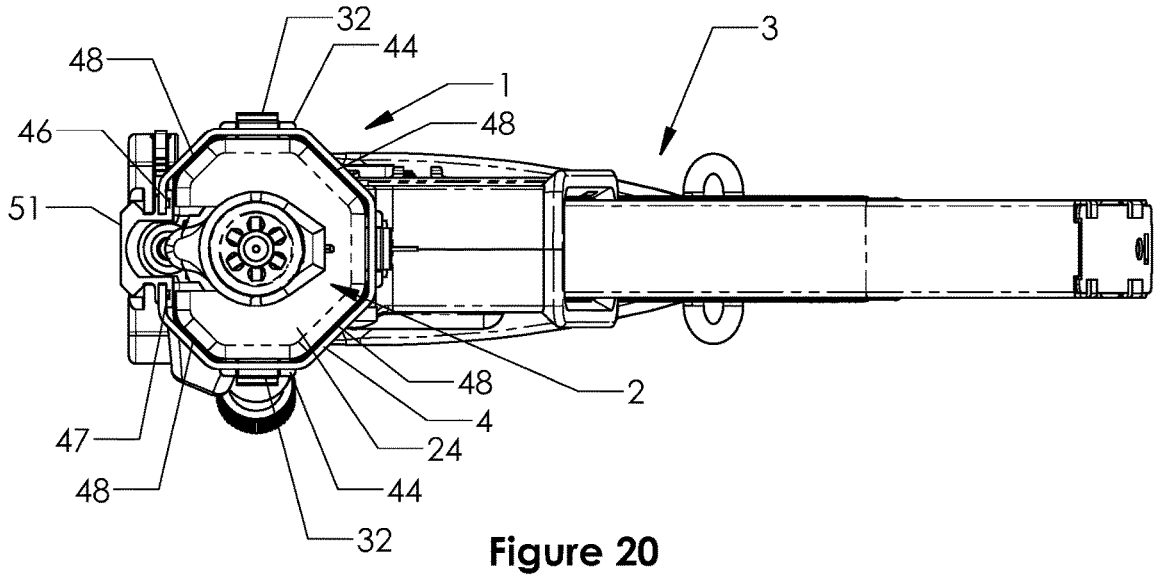
FIG. 20 is a Front view of the rail and barrel assemblies.
Figure 21:
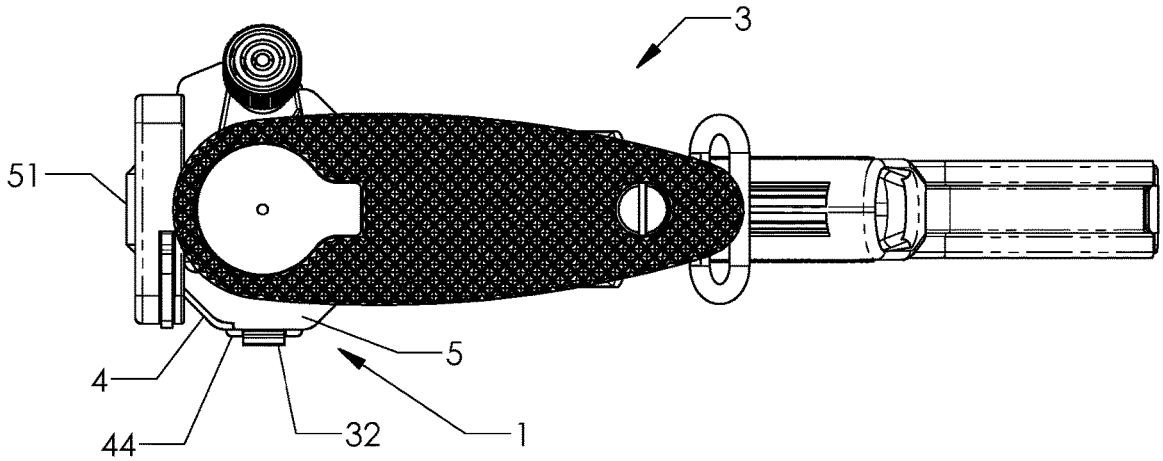
FIG. 21 is a Rear view of the rail and barrel assemblies.
Figure 22:
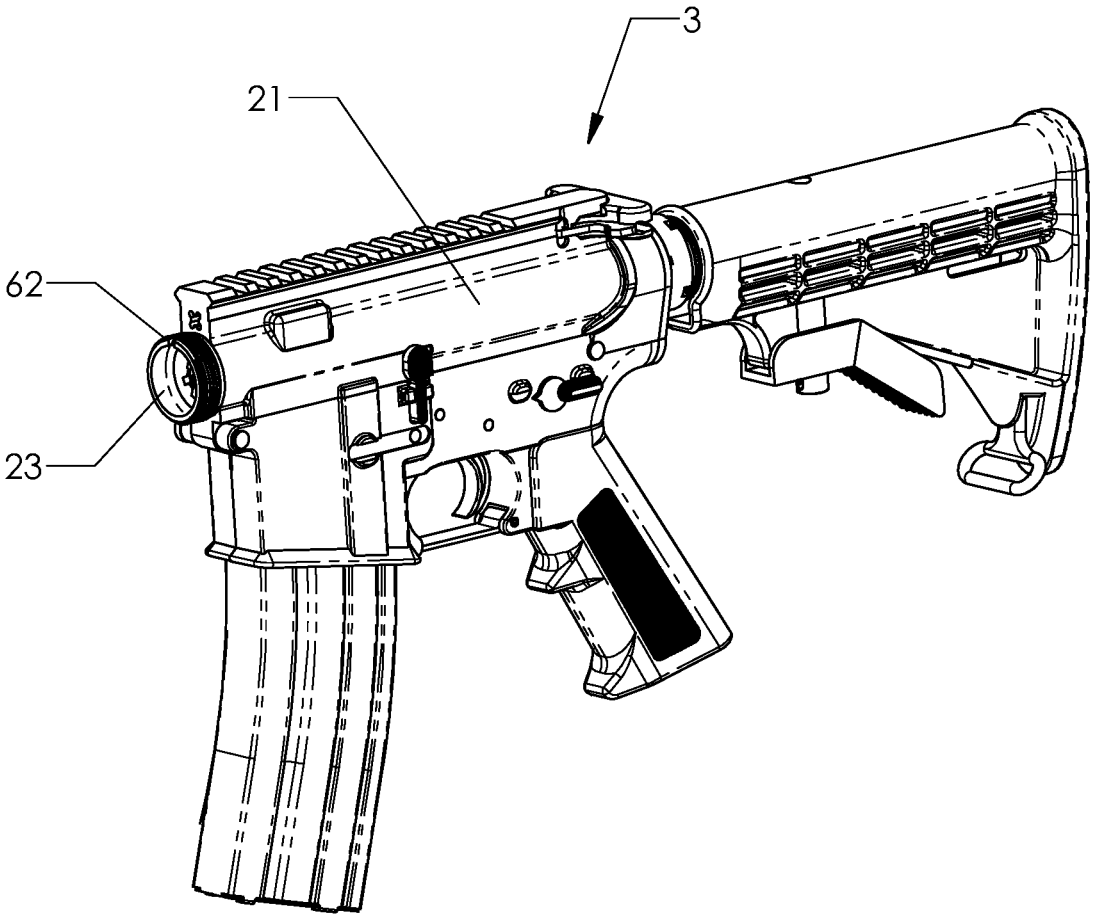
FIG. 22 is an Isometric view of the rifle assembly.

Referring to FIGS. 4, 6, 10, 12, 13, 14 and 22, rail mount 5 is attached to the AR-15 rifle assembly 3 by means of interface sleeve 6 threaded onto receiver interface 62 on upper receiver 21. Rail mount 5 is attached to interface sleeve 6 by a polarity of cone set screws 60 tightened into the Interface sleeve notch 14. Referring to FIGS. 15 and 16, alignment pins 43 are pressed into the rear surface of rail mount 5 to align rail mount 5 to the upper receiver 21. This becomes the attach point for rail assembly 1 and barrel assembly 2.

Referring to FIGS. 2, 5, 6, 7, 13, 14, 17, 18, 19, 20 and 21, in the fully assembled and locked position, rail assembly 1 is slid onto rail mount 5. Rail mount 5 is permanently secured to upper receiver 21 on AR-15 rifle assembly 3. The rail 4 is tightly positioned on rail mount 5 by the interior surface 56 of rail 4 contacting the rear mating surfaces 52 on rail mount 5. The rail 4 is also positioned by a plurality of raised projections 48 contacting the front mating surface 49 on rail mount 5.

Rail lock lever 35 is in position so the rail lever stop 27 is in contact and interferes with the rail mount face 28, biasing rail 4 against the mount stop 57 on rail mount 5. The opposite lever is part of assembly rail lever left 31 is also in the closed lock position. Each of these levers are locked in this position by means of rail lever retainer 32 sliding in rail lever retainer slot 38 to a position where the rail lever retainer pawl 34 on rail lock lever 35 is captured by the rail lever retainer notch 33 on the rail lever retainer 32. The rail lever spring 37 biases the rail lock lever 35 so the rail lever retainer 32 remains in place. This forms a detent-type lock that can only be released if rail lever spring 37 is depressed by rail lock lever 35 to release the rail lever retainer 32.

Referring to FIGS. 2, 3, 4, 7, 13, 14, 17, 18, 19, 20 and 21, in the fully assembled and locked position, barrel assembly 2 is slid into the rail mount inside cavity 65 of rail mount 5. This provides a tight slip fit 41 between the barrel bushing left 18 and barrel bushing right 19 on barrel 39. Barrel lock lever 7 is in position so the barrel lever stop 15 passes through barrel bushing aperture 20 is in contact and interferes with the barrel bushing aperture face 17, biasing the barrel bushing left 18 and barrel bushing right 19 against barrel extension face 26 on barrel extension 22. This bias presses the barrel assembly 2 by means of barrel extension 22 into the upper receiver cavity 23 on the upper receiver 21. A polarity of barrel lever stop adjustment screws 16 in barrel lever stop 15 allow adjustment of the barrel assembly 2 relative to the upper receiver 21 for manufacturing tolerances.

The barrel lock lever 7 is locked in this position by means of barrel lever retainer 12 sliding in barrel lever retainer slot 25 to a position where the barrel lever retainer pawl 13 on barrel lock lever 7 is captured by the barrel lever retainer notch 45 on the barrel lever retainer 12. The barrel lever spring 10 biases the barrel lock lever 7 so the barrel lever retainer 12 remains in place. This forms a detent-type lock that can only be released if barrel lever spring 10 is depressed by barrel lock lever 7 to release the barrel lever retainer 12.

Figure 1:
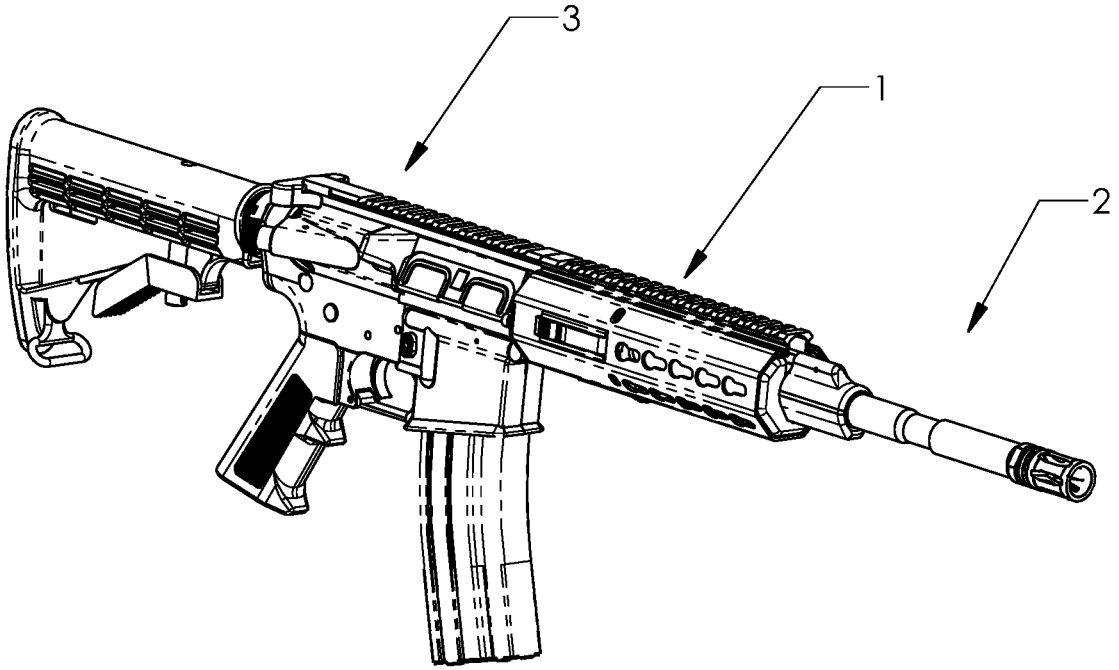
FIG. 1 is an Isometric view of the rail and barrel assemblies.
Figure 2:
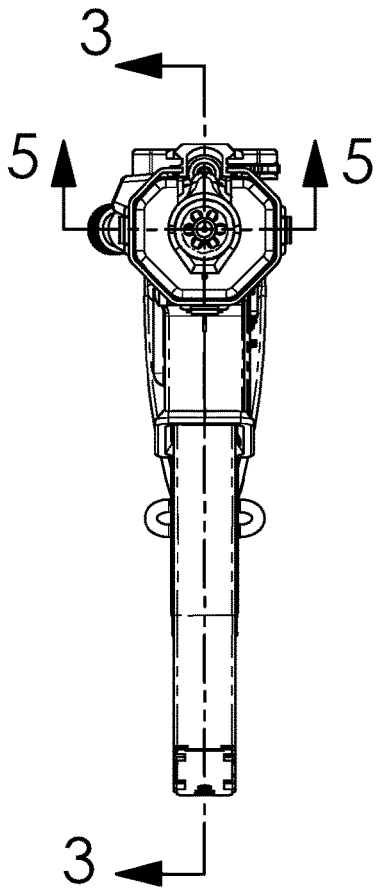
FIG. 2 is a Front view of the rail and barrel assemblies.
Figure 3:
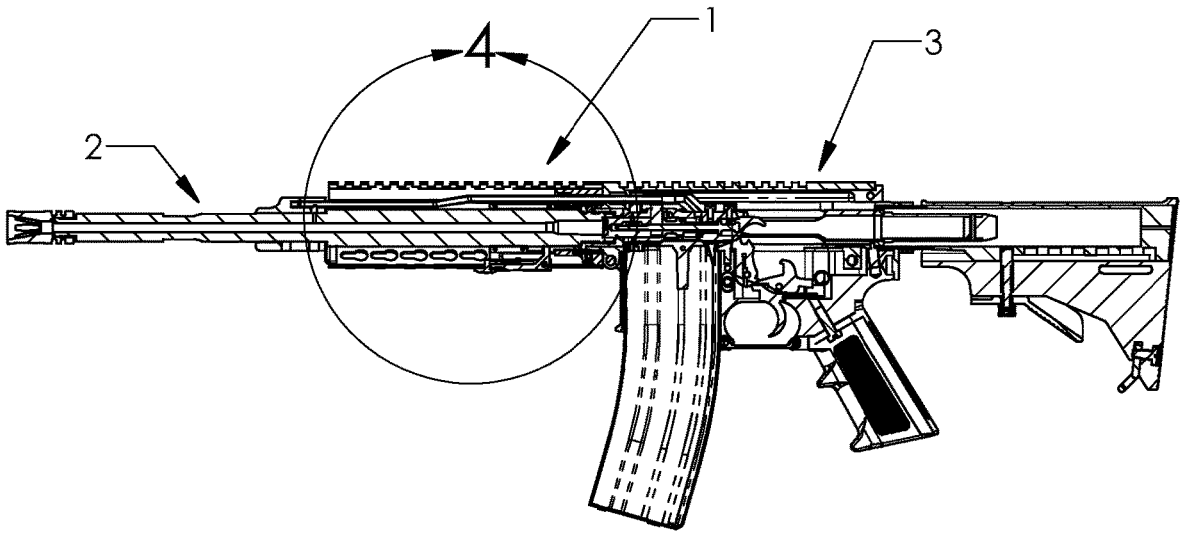
FIG. 3 is a Left Section View of FIG. 2.
Figure 4:
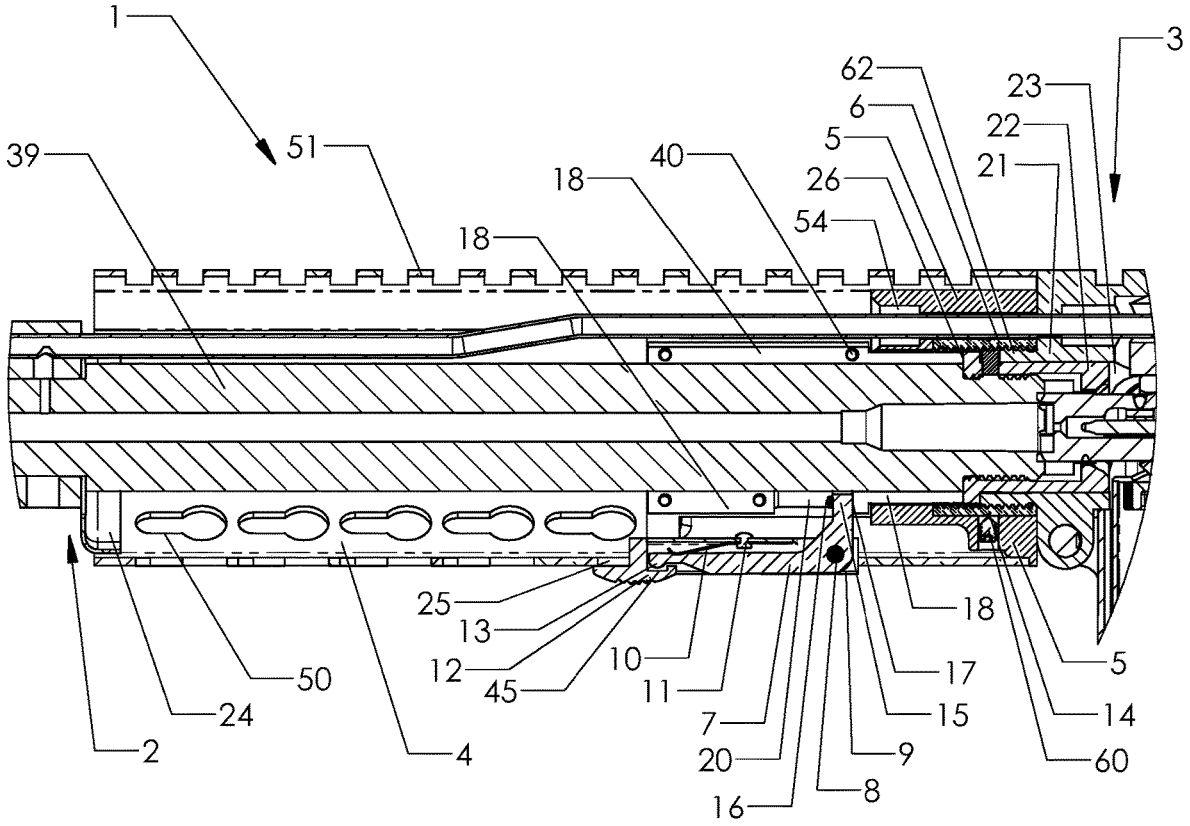
FIG. 4 is a magnified Detail View of FIG. 3.
Figure 5:
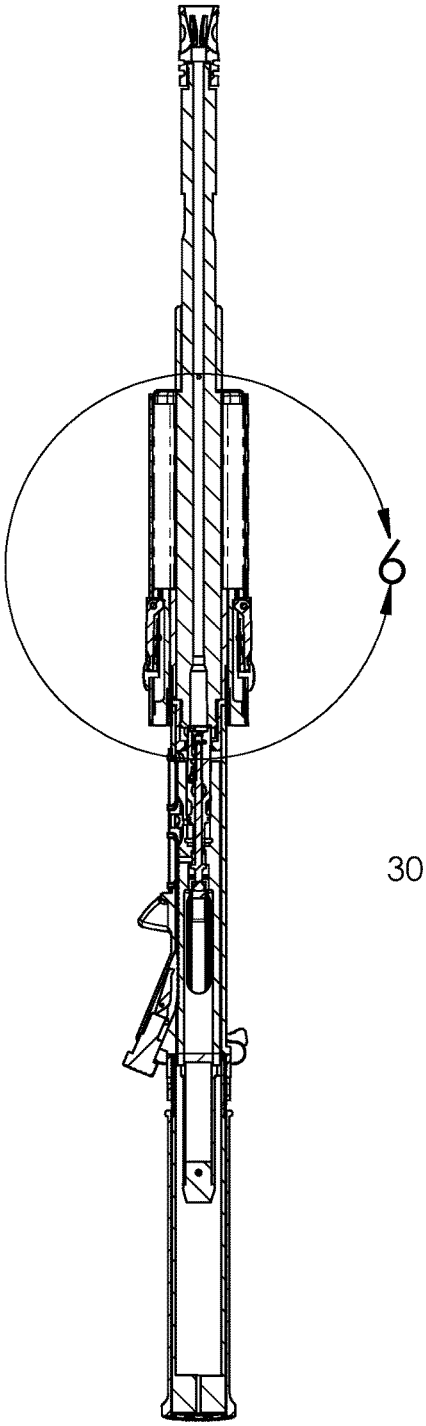
FIG. 5 is a Top Section View of FIG. 3 further depicting the rail and barrel assemblies.
Figure 6:
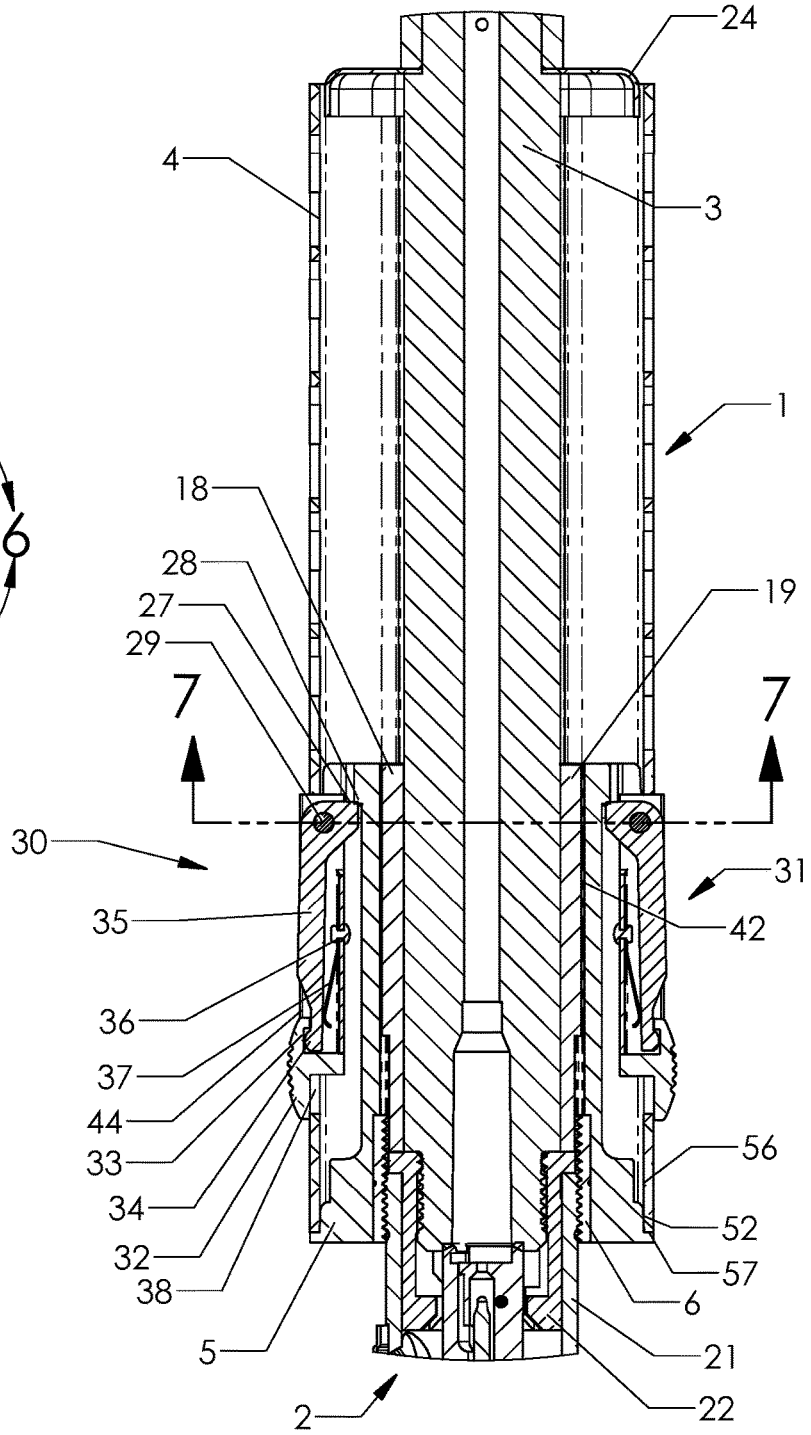
FIG. 6 is a magnified Detail View of FIG. 5.
Figure 7:
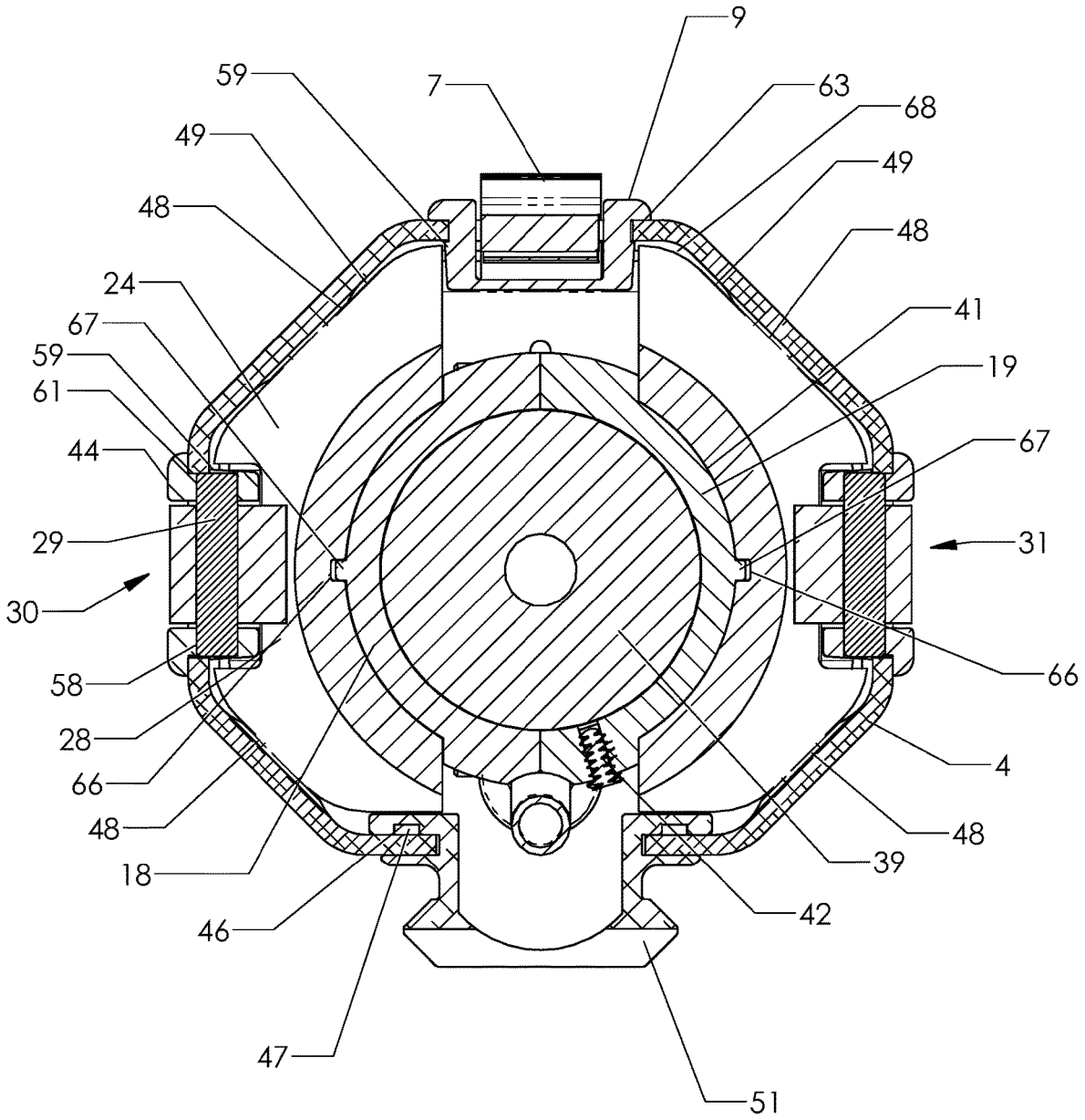
FIG. 7 is a Section View of FIG. 6.
Figure 8:
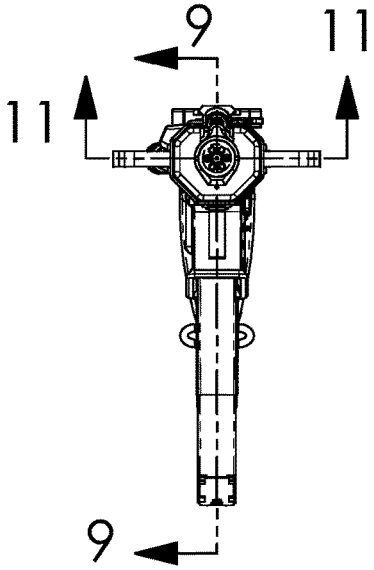
FIG. 8 is a Front view of the rail and barrel assemblies.
Figure 9:
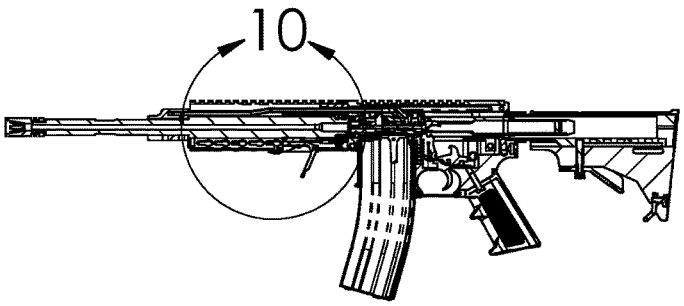
FIG. 9 is a Section view of FIG. 8.
Figure 10:
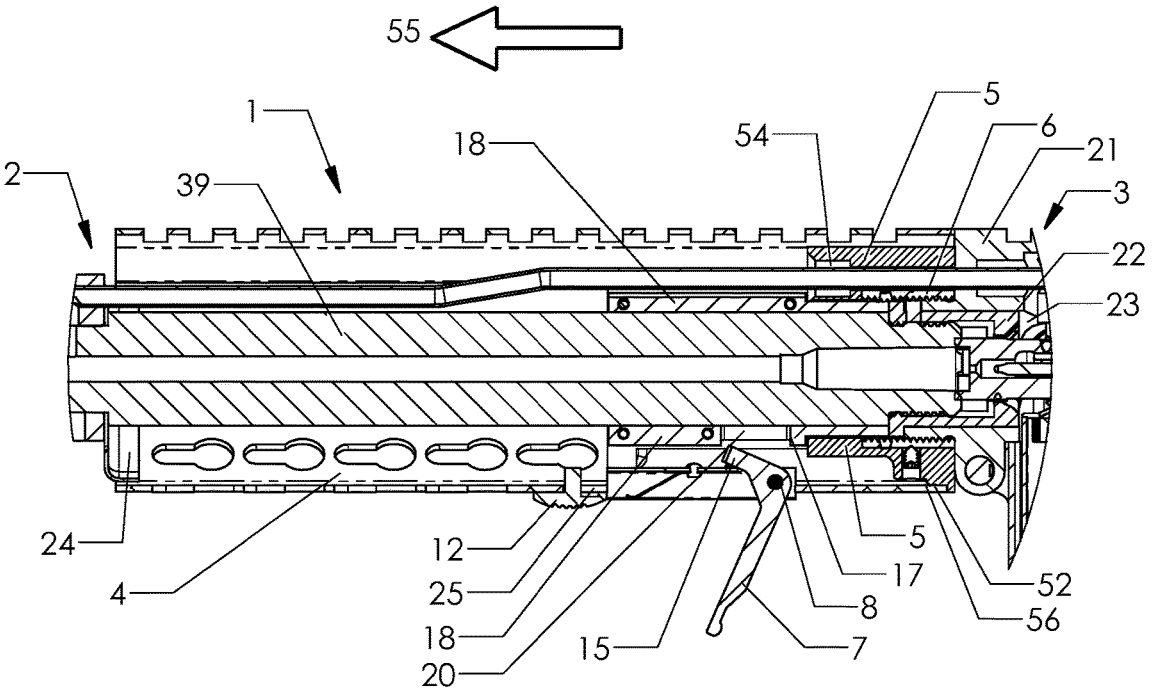
FIG. 10 is a magnified Detail view of FIG. 9.
Figure 11:
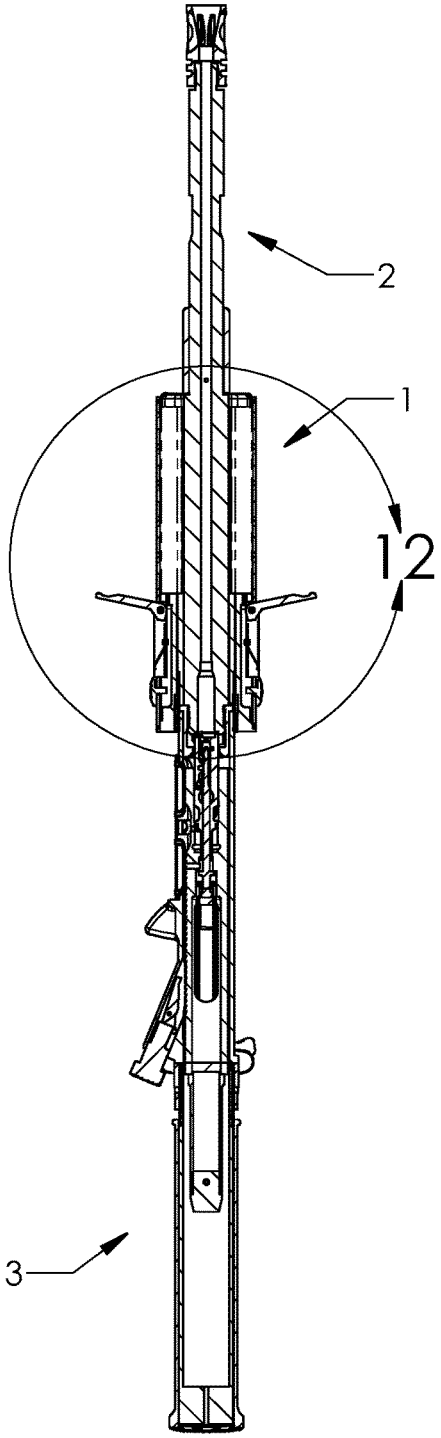
FIG. 11 is a Section view of FIG. 8.
Figure 12:
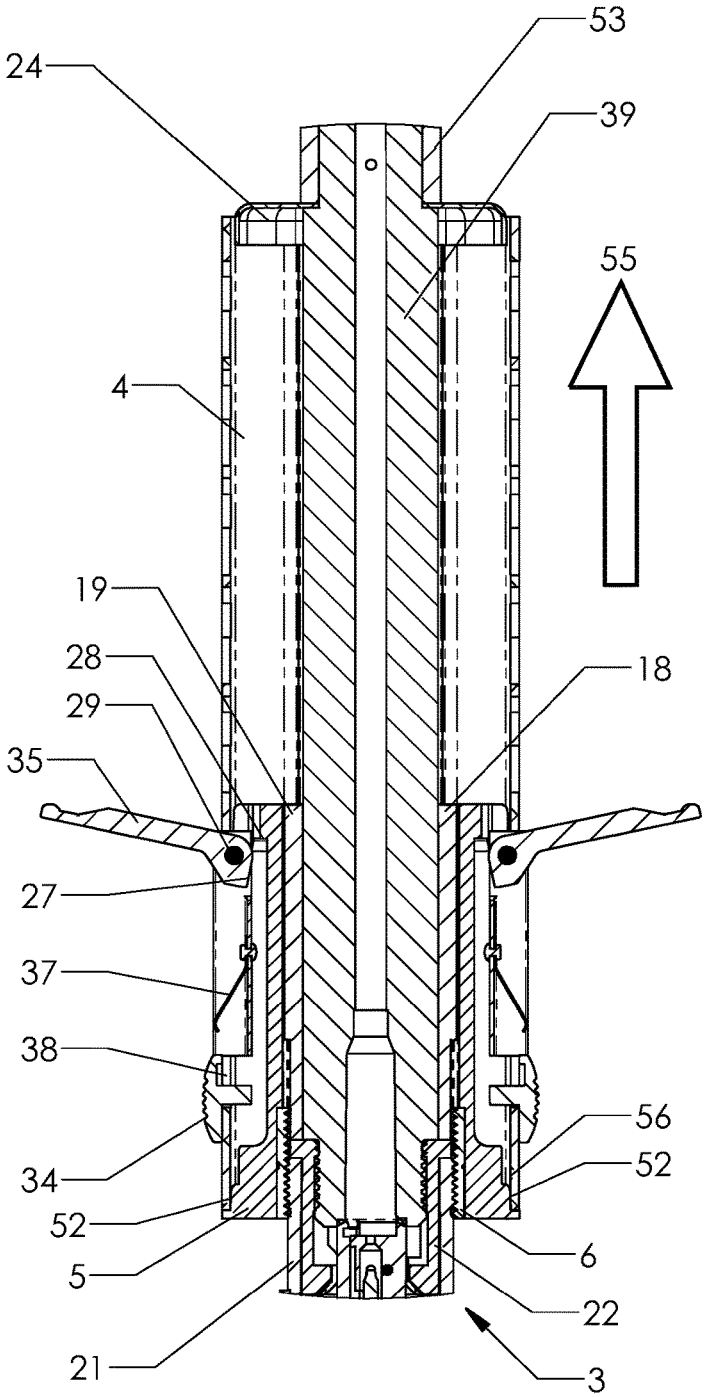
FIG. 12 is a magnified Detail view of FIG. 11.

Referring to FIG. 7, a spline interface between the inside cavity 65 in rail mount 5 and barrel bushing left 18 and barrel bushing right 19 on barrel 39 is formed by a barrel spline grove 66 in rail mount 5 and barrel spline projection 67 on barrel bushing left 18 and barrel bushing right 19. This stabilizes the motion in the barrel 39.

Referring to FIGS. 8, 9, 10, 13 and 14, in the fully unlocked position the barrel assembly 2 is allowed to slide free, in direction 55, from the inside cavity in rail mount 5. The barrel lock lever 7 is depressed to unlock the detent lock formed by barrel lever retainer notch 45 on the barrel lever retainer 12 and barrel lever retainer pawl 13 on barrel lock lever 7. This allows barrel lever retainer 12 to move in barrel lever retainer slot 25 to a position where barrel lock lever 7 can swing free and remove contact between barrel lever stop 15 and barrel bushing aperture face 17.

Referring to FIGS. 8, 11, 12, 13 and 14 In the fully unlocked position, the rail assembly 1 is allowed to slide, in direction 55, free from rail mount 5. The rail lock levers 35 are depressed to unlock the detent lock formed by rail lever retainer notch 33 on the rail lever retainer 32 and rail lever retainer pawl 34 on rail lock lever 35. This allows rail lever retainer 32 to move in rail lever retainer slot 38 to a position where rail lock levers 35 can swing free and remove contact between rail lever stop 27 and rail mount face 28. Referring to FIG. 7, front rail cover 24 snapped onto barrel 39, has an all-around gap 68 and does not touch rail 4. This makes rail assembly 1 free floating. Front rail cover 24 is not purely decorative and protects the rail assembly 1, if dropped or abused, by limiting its travel.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

1 Rail assembly
2 Barrel assembly
3 AR-15 rifle assembly
4 Rail
5 Rail mount (also referred to as "an elongate rail mount")
6 Interface sleeve (also referred to as "sleeve")
7 Barrel lever
8 Lever pin
9 Barrel lever mount
10 Barrel lever spring
11 Rivet
12 Barrel lever retainer
13 Barrel lever pawl
14 Interface sleeve notch
15 Barrel lever stop
16 Barrel lever stop adjustment screw
17 Barrel bushing aperture face (also referred to as "opening on bushing")
18 Barrel bushing Left
19 Barrel bushing right
20 Barrel bushing aperture
21 Upper receiver
22 Barrel extension
23 Upper receiver cavity
24 Front rail cover
25 Barrel lever retainer slot
26 Barrel extension face
27 Rail lever stop
28 Rail mount face
29 Rail lever pin
30 Assembly rail lever right
31 Assembly rail lever left
32 Rail lever retainer
33 Rail lever retainer notch
34 Rail lever retainer pawl
35 Rail lever
36 Rail lever spring rivet
37 Rail lever spring
38 Rail lever retainer slot
39 Barrel
40 Barrel bushing screw
41 Slip fit
42 Set screw
43 Alignment pin
44 Rail lever mount
45 Barrel lever retainer notch
46 Rail groove
47 Rail stud projection
48 Raised projection (i.e., "first end of rail that securely mates with flared cambered portions)
49 Front mating surface (also referred to as "flared cambered portions")
50 Keyhole slot
51 Top rail mount
52 Rear mating surface
53 Gas block
54 Gas tube
55 Disassembly direction
56 Interior surface
57 Mount stop
58 Rail lever pin aperture
59 Tab lock
60 Cone set screw
61 Rail lever aperture
62 Receiver interface
63 Barrel lever aperture
64 Barrel lever pin aperture
65 Rail mount Inside cavity
66 Barrel spline projection
67 Barrel spline groove
68 Gap

What is claimed is:

1. A rifle comprising:

(a) a rifle assembly for attachment to a release assembly that forms the rifle when completely assembled, the release assembly, comprising:

(b) a rail assembly including:

(i) a sleeve configured to directly attach to the rifle assembly;

(ii) an elongate rail mount having a first end and second end that are spaced apart from one another, wherein:

the first end of the elongate rail mount securely receives the sleeve of the rail assembly therein, and the spaced apart second end of the elongate rail mount has flared portions that are configured to securely mate within a rail of the rail assembly; and (iii) a rail having a first end and second end that are spaced apart from one another, wherein:

the first end of the rail is configured to receive and securely mate with the flared portions of the second end of the elongate rail mount to align the sleeve, elongate rail mount, and rail along the longitudinal axis of the rail assembly, the first end of the rail further includes a plurality of securing levers positioned externally thereon with a first securing lever configured to engage and disengage the elongate rail mount and a second securing lever configured to engage and disengage a barrel assembly to release the rail and barrel assemblies from the rifle assembly, and the second end of the rail is configured to receive the barrel assembly therein; and (c) the barrel assembly including a barrel having a first end and a second end that are spaced apart from one another, wherein:

a portion of the barrel assembly is configured to advance through the rail of the rail assembly and is securely received within the second end of the elongate rail mount such that the second securing lever of the rail assembly securely engages the barrel assembly such that the barrel assembly and rail assembly are aligned to form an internal channel in fluid communication with the one another when the rifle is assembled.

2. The rifle of claim 1, wherein the barrel assembly further comprises a bushing configured for fastening around the first end of the barrel of the barrel assembly, the bushing having an opening that receives an arm of the second securing lever therein when the second securing lever is in an engaged position thereby securing the barrel assembly to the rail assembly.

3. The rifle of claim 1, wherein an inner diameter of the first end of the elongate rail mount securely engages the outer diameter of the sleeve of the rail assembly.

4. The rifle of claim 1, wherein the flared portions of the elongate rail mount extend beyond an outer diameter of a main body of the elongate rail mount and are configured to align and securely mate within openings positioned on the rail.

5. The rifle of claim 1, wherein each of the plurality of securing levers is coplanar or recessed relative to an outer surface of the rail when in an engaged state.

6. The rifle of claim 1, wherein each of the plurality of securing levers is perpendicular relative to the longitudinal axis of the rail assembly when in a disengaged state.

7. The rifle of claim 1, wherein the rail assembly, barrel assembly, or a combination thereof are detachable from the rifle assembly without the use of any additional tools.

8. A quick release assembly configured for attachment to a rifle assembly, the quick release assembly comprising:

(a) a rail assembly including:

(i) a sleeve configured to attach to the rifle assembly;

(ii) an elongate rail mount having a first end and second end, wherein:

the first end of the elongate rail mount securely receives the sleeve of the rail assembly therein, and the spaced apart second end of the elongate rail mount has flared portions that are configured to securely mate within a rail of the rail assembly; and (iii) a rail having a first end and second end, wherein:

the first end of the rail is configured to receive and securely mate with the flared portions of the second end of the elongate rail mount to align the sleeve, elongate rail mount, and rail along the longitudinal axis of the rail assembly, the first end of the rail further includes securing levers positioned externally thereon with a first securing lever configured to engage and disengage the elongate rail mount and a second securing lever configured to engage and disengage a barrel assembly to release the rail and barrel assemblies from the rifle assembly; and (b) the barrel assembly including a barrel having a first end and a second end, wherein:

a portion of the barrel assembly is configured to advance through the rail of the rail assembly and is received within the second end of the elongate rail mount such that the second securing lever of the rail assembly securely engages the barrel assembly such that the barrel assembly and rail assembly are aligned to form an internal channel.

9. The quick release assembly of claim 8, wherein the barrel assembly further comprises a bushing configured for fastening around the first end of the barrel of the barrel assembly, the bushing having an opening that receives an arm of the second securing lever therein when the second securing lever is in an engaged position thereby securing the barrel assembly to the rail assembly.

10. The quick release assembly of claim 8, wherein an inner diameter of the first end of the elongate rail mount securely engages the outer diameter of the sleeve of the rail assembly.

11. The quick release assembly of claim 8, wherein the flared portions of the elongate rail mount extend beyond an outer diameter of a main body of the elongate rail mount and are configured to align and securely mate within openings positioned on the rail.

12. The quick release assembly of claim 8, wherein each of the plurality of securing levers is coplanar or recessed relative to an outer surface of the rail when in an engaged state.

13. The quick release assembly of claim 8, wherein each securing lever is perpendicular relative to the longitudinal axis of the rail assembly when in a disengaged state.

14. The quick release assembly of claim 8, wherein the rail assembly, barrel assembly, or a combination thereof are detachable from the rifle assembly without the use of any additional tools.

* * * * *